US007969451B2

(12) United States Patent
Marion et al.

(10) Patent No.: US 7,969,451 B2
(45) Date of Patent: Jun. 28, 2011

(54) METHOD AND APPARATUS FOR DYNAMICALLY SIZING COLOR TABLES

(75) Inventors: Neal Richard Marion, Georgetown, TX (US); George F. Ramsay, III, Cedar Park, TX (US); James Stanley Tesauro, Austin, TX (US)

(73) Assignee: International Business Machines Corporation, Armonk, NY (US)

( * ) Notice: Subject to any disclaimer, the term of this patent is extended or adjusted under 35 U.S.C. 154(b) by 1876 days.

(21) Appl. No.: 10/402,110

(22) Filed: Mar. 27, 2003

(65) Prior Publication Data

US 2004/0189660 A1 Sep. 30, 2004

(51) Int. Cl.
*G09G 5/02* (2006.01)

(52) U.S. Cl. ..... 345/601

(58) Field of Classification Search ..... 345/601, 345/602

See application file for complete search history.

(56) References Cited

U.S. PATENT DOCUMENTS

| | | | | |
|---|---|---|---|---|
| 4,847,604 | A | 7/1989 | Doyle | 340/706 |
| 5,025,249 | A * | 6/1991 | Seiler et al. | 345/803 |
| 5,195,403 | A | 3/1993 | Sani et al. | 76/108.6 |
| 5,218,431 | A | 6/1993 | Gleicher et al. | 358/13 |
| 5,278,678 | A | 1/1994 | Harrington | 358/518 |
| 5,406,310 | A * | 4/1995 | Aschenbrenner et al. | 345/602 |
| 5,430,465 | A | 7/1995 | Sabella et al. | 345/199 |
| 5,459,486 | A | 10/1995 | Iverson et al. | 345/153 |
| 5,629,720 | A | 5/1997 | Cherry et al. | 345/119 |
| 5,629,723 | A | 5/1997 | West et al. | 345/201 |
| 5,673,065 | A | 9/1997 | DeLeeuw | 345/153 |
| 5,703,627 | A | 12/1997 | Young | 345/199 |
| 5,748,176 | A | 5/1998 | Gondek | 345/131 |
| 5,828,779 | A | 10/1998 | Maggioni | 382/165 |
| 5,874,967 | A | 2/1999 | West et al. | 345/435 |
| 5,990,864 | A | 11/1999 | DeAguiar et al. | 345/150 |
| 6,011,540 | A | 1/2000 | Berlin et al. | 345/153 |
| 6,038,374 | A | 3/2000 | Jacob et al. | 395/109 |
| 6,326,974 | B1 | 12/2001 | Satoh et al. | 345/581 |
| 6,380,945 | B1 | 4/2002 | MacInnis et al. | 345/602 |
| 6,466,224 | B1 | 10/2002 | Nagata et al. | 345/592 |
| 6,518,981 | B2 | 2/2003 | Zhao et al. | 345/764 |
| 6,573,904 | B1 | 6/2003 | Chun et al. | 345/629 |
| 6,819,331 | B2 * | 11/2004 | Shih et al. | 345/602 |
| 2002/0044150 | A1 | 4/2002 | Sato et al. | 345/600 |
| 2002/0145611 | A1 | 10/2002 | Dye et al. | 345/543 |

FOREIGN PATENT DOCUMENTS

EP 0 855 601 A1 7/1998

OTHER PUBLICATIONS

Marion et al., Method and Apparatus for Managing Dynamically Sizeable Color Tables.

Schnaitter et al., "A 170-MHz CMOS Pixel Processor for Windowing Graphics", IEEE Journal of Solid-State Circuits, New York, 1992, vol. 27, No. 3, pp. 406-415.

* cited by examiner

*Primary Examiner* — Aaron M Richer

(74) *Attorney, Agent, or Firm* — Yee & Associates, P.C.; Diana R. Gerhardt

(57) ABSTRACT

A method, apparatus, and computer instructions for storing colors in a color table used in displaying graphics in a data processing system. A request for a color map is received, wherein the request includes a number of entries for the color map. A color map location and size in the color table is set based on the number of entries in the request. Colors for the color map are loaded into the color table at the color map location, wherein dynamic sizing of color tables occurs.

13 Claims, 3 Drawing Sheets

METHOD AND APPARATUS FOR DYNAMICALLY SIZING COLOR TABLES

CROSS REFERENCE TO RELATED APPLICATIONS

The present invention is related to the following applications entitled: "Method and Apparatus for Managing Dynamically Sizeable Color Tables," Ser. No. 10/402,076; all filed even date hereof, assigned to the same assignee, and incorporated herein by reference.

BACKGROUND OF THE INVENTION

1. Technical Field

The present invention relates generally to an improved data processing system, and in particular a method and apparatus for processing graphics data. Still more particularly, the present invention provides a method, apparatus, and computer instructions for storing color maps in a data processing system.

2. Description of Related Art

Computer graphics concerns the synthesis or display of real or imaginary objects from computer-based models. In computer graphics systems, images are displayed on a display device to a user in two dimensional and three dimensional forms. These images are displayed using pixels. A pixel is short for a picture element. One spot in a rectilinear grid of thousands of such spots that are individually "painted" to form an image produced on the screen by a computer or on paper by a printer. A pixel is the smallest element that display or print hardware and software can manipulate in creating letters, numbers, or graphics. These pixels and information relating to these pixels are stored in a buffer. The information describing a pixel is identified using a window ID (WID). A WID is used as an index into a window attribute table (WAT). The WAT contains information describing how a pixel will be displayed on the screen. For example, a WAT identifies depth, color map, buffer, and gamma for a pixel.

In displaying pixels, a color table, also referred to as a "color lookup table," is a piece of hardware in which pixel values or colors may be stored. A color map is a list of colors used to display pixels in a window or application. This list of colors must be loaded into a color table to be used. Presently, color tables on a graphics adapter are defined as fixed size tables with the most common size being 256 entries. This size color table is one required to support a fully populated 8-bit color map.

The present invention recognizes that many applications create color maps and only populate the first few entries, leaving many unused color table entries. Typically, each application will use a single color table for its color map. Most adapters provide very few color tables, resulting in the sharing of entries within a color table by applications. Such a sharing of color tables results in technicolor, which causes a window to be displayed with the wrong color map values. In other words, a window may be displayed with the incorrect colors due to a sharing of the color table with multiple applications.

Thus, it would be advantageous to have an improved method, apparatus, and computer instructions for storing colors in a color table.

SUMMARY OF THE INVENTION

The present invention provides a method, apparatus, and computer instructions for storing colors in a color table used in displaying graphics in a data processing system. A request for a color map is received, wherein the request includes a number of entries for the color map. A color map location and size in the color table is set based on the number of entries in the request. Colors for the color map are loaded into the color table at the color map location, wherein dynamic sizing of color tables occurs.

BRIEF DESCRIPTION OF THE DRAWINGS

The novel features believed characteristic of the invention are set forth in the appended claims. The invention itself, however, as well as a preferred mode of use, further objectives and advantages thereof, will best be understood by reference to the following detailed description of an illustrative embodiment when read in conjunction with the accompanying drawings, wherein:

DETAILED DESCRIPTION OF THE PREFERRED EMBODIMENT

Figure 1:
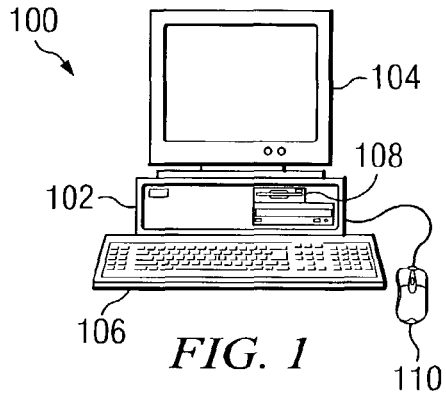
FIG. 1 is a pictorial representation of a data processing system in which the present invention may be implemented in accordance with a preferred embodiment of the present invention.

With reference now to the figures and in particular with reference to FIG. 1, a pictorial representation of a data processing system in which the present invention may be implemented is depicted in accordance with a preferred embodiment of the present invention. A computer 100 is depicted which includes a system unit 102, a video display terminal 104, a keyboard 106, storage devices 108, which may include floppy drives and other types of permanent and removable storage media, and mouse 110. Additional input devices may be included with personal computer 100. Computer 100 can be implemented using any suitable computer, such as an IBM RS/6000 computer or IntelliStation computer, which are products of International Business Machines Corporation, located in Armonk, N.Y. Although the depicted representation shows a computer, other embodiments of the present invention may be implemented in other types of data processing systems, such as a network computer. Computer 100 also preferably includes a graphical user interface that may be implemented by means of systems software residing in computer readable media in operation within computer 100.

Figure 2:
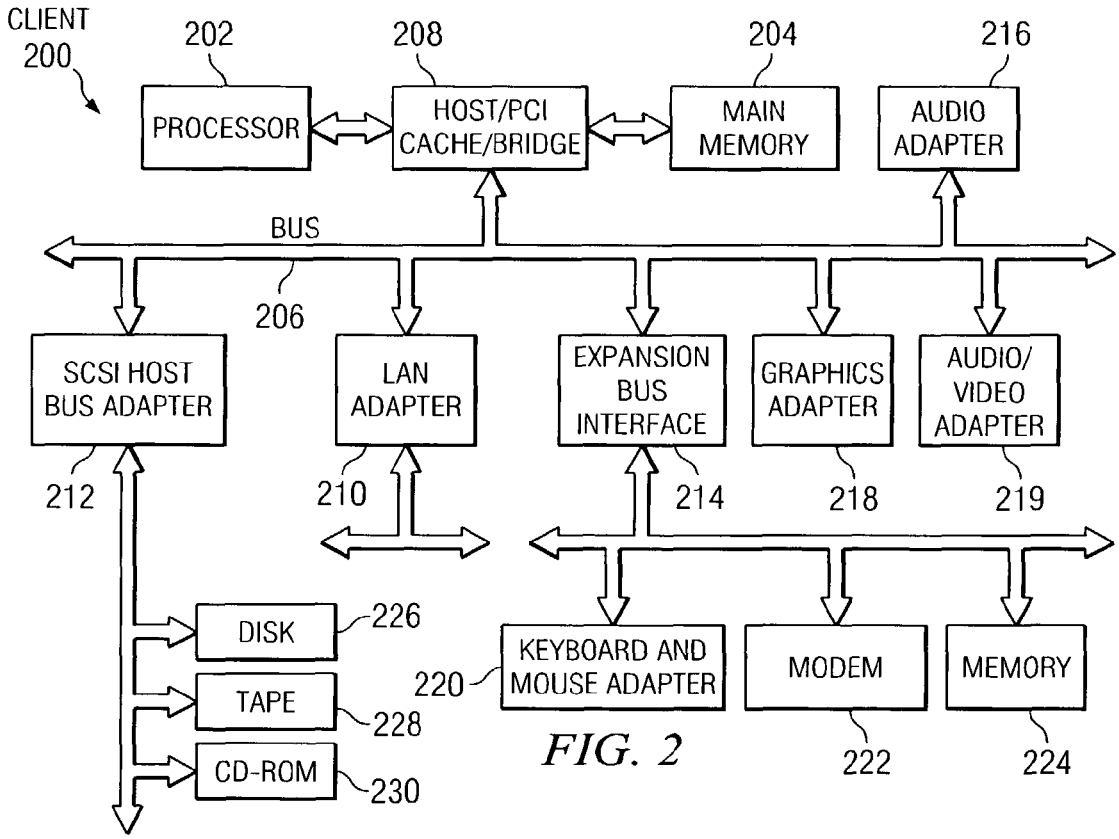
FIG. 2 is a block diagram illustrating a data processing system in which the present invention may be implemented.

With reference now to FIG. 2, a block diagram illustrates a data processing system in which the present invention may be implemented. Data processing system 200 is an example of a computer, such as computer 100 in FIG. 1, in which code or instructions implementing the processes of the present invention may be located. Data processing system 200 employs a peripheral component interconnect (PCI) local bus architecture. Although the depicted example employs a PCI bus, other bus architectures such as Accelerated Graphics Port (AGP) and Industry Standard Architecture (ISA) may be used. Processor 202 and main memory 204 are connected to PCI local bus 206 through PCI bridge 208. PCI bridge 208 also may include an integrated memory controller and cache memory for processor 202. Additional connections to PCI local bus 206 may be made through direct component interconnection or through add-in boards. In the depicted example, local area network (LAN) adapter 210, small computer system interface SCSI host bus adapter 212, and expansion bus interface 214 are connected to PCI local bus 206 by direct component connection. In contrast, audio adapter 216, graphics adapter 218, and audio/video adapter 219 are connected to PCI local bus 206 by add-in boards inserted into expansion slots. The processes of the present invention may be used to manage rendering of data by graphics adapter 218 or audio/video adapter 219.

Expansion bus interface 214 provides a connection for a keyboard and mouse adapter 220, modem 222, and additional memory 224. SCSI host bus adapter 212 provides a connection for hard disk drive 226, tape drive 228, and CD-ROM drive 230. Typical PCI local bus implementations will support three or four PCI expansion slots or add-in connectors.

An operating system runs on processor 202 and is used to coordinate and provide control of various components within data processing system 200 in FIG. 2. The operating system may be a commercially available operating system such as Windows XP, which is available from Microsoft Corporation. Instructions for the operating system and applications or programs are located on storage devices, such as hard disk drive 226, and may be loaded into main memory 204 for execution by processor 202.

Those of ordinary skill in the art will appreciate that the hardware in FIG. 2 may vary depending on the implementation. Other internal hardware or peripheral devices, such as flash ROM (or equivalent nonvolatile memory) or optical disk drives and the like, may be used in addition to or in place of the hardware depicted in FIG. 2. Also, the processes of the present invention may be applied to a multiprocessor data processing system.

For example, data processing system 200, if optionally configured as a network computer, may not include SCSI host bus adapter 212, hard disk drive 226, tape drive 228, and CD-ROM 230. In that case, the computer, to be properly called a client computer, must include some type of network communication interface, such as LAN adapter 210, modem 222, or the like. As another example, data processing system 200 may be a stand-alone system configured to be bootable without relying on some type of network communication interface, whether or not data processing system 200 comprises some type of network communication interface. As a further example, data processing system 200 may be a Personal Digital Assistant (PDA) device which is configured with ROM and/or flash ROM in order to provide non-volatile memory for storing operating system files and/or user-generated data.

The depicted example in FIG. 2 and above-described examples are not meant to imply architectural limitations. For example, data processing system 200 also may be a notebook computer or hand held computer in addition to taking the form of a PDA. Data processing system 200 also may be a kiosk or a Web appliance.

Figure 3:
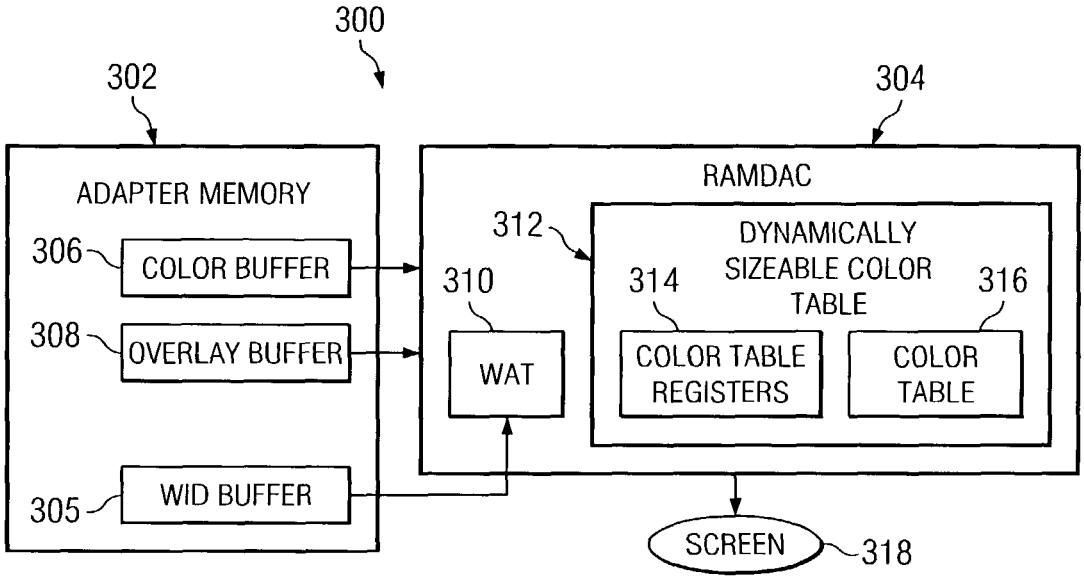
FIG. 3 is a block diagram illustrating a graphics adapter in accordance with a preferred embodiment of the present invention.

Turning next to FIG. 3, a block diagram illustrating a graphics adapter is depicted in accordance with a preferred embodiment of the present invention. Graphics adapter 300 is an example of a graphics adapter, such as graphics adapter 218 in FIG. 2.

In this example, graphics adapter 300 includes an adapter memory 302 and a random access memory digital to analog converter (RAMDAC) 304. Adapter memory 302 contains window ID (WID) buffer 305, color frame buffer 306, and overlay frame buffer 308. RAMDAC 304 includes window attribute table (WAT) table 310 and dynamically sizeable color table 312, which includes color table registers 314 and color table 316. The two frame buffers, color frame buffer 306 and overlay frame buffer 308, contain pixels, which are sent to RAMDAC 304 for output to a display device, such as screen 318. RAMDAC 304 is a graphics controller chip that maintains the color palette and converts data from memory into analog signals for a display device. The color palette takes the form of color maps and is maintained within dynamically sizable color table 312.

In these examples, a dynamic color table is provided, dynamically sizeable color table 312, to facilitate a more efficient use of space within this color table. The mechanism of the present invention allows for dynamically changing the entries provided for color maps. The size and location of different sets of entries for different color maps are controlled through color table registers 314. Through the use of color table registers 314 and color table 316, a single color table may be employed to hold or contain multiple color maps in which the color maps are assigned only the space needed.

In this manner, problems, such as technicolor, maybe avoided with limited numbers of color tables in a graphics adapter. For example, if a single color map uses only eight colors, only eight color table entries are needed instead of a full 256 entry color table. Previously, such a color map would require the use of the entire 256 color table because no mechanism was provided for dynamically sizing within the color table. With the present invention, the remaining entries in the color table are available for use by other color maps.

Figure 4:
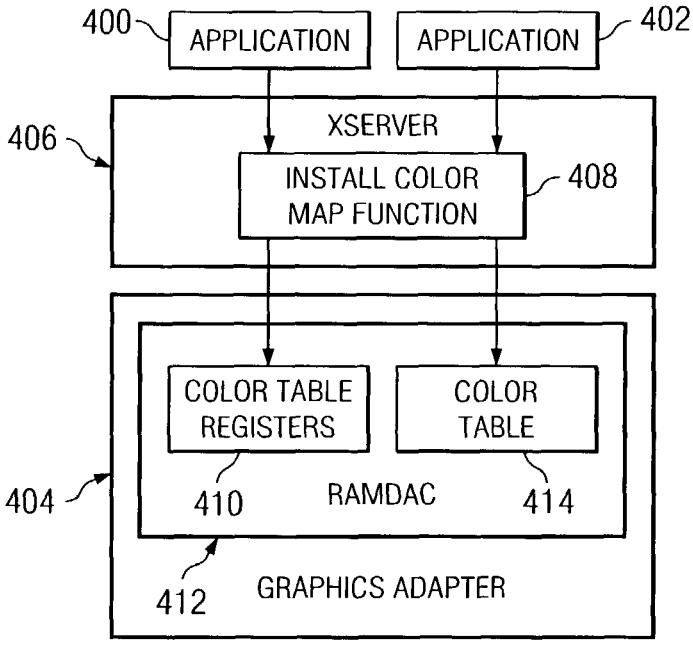
FIG. 4 is a diagram illustrating components and data flow used in dynamically sizing a color table in accordance with a preferred embodiment of the present invention.

Turning next to FIG. 4, a diagram illustrating components and data flow used in dynamically sizing a color table are depicted in accordance with a preferred embodiment of the present invention.

Application 400 and application 402 may generate requests to install color maps in graphics adapter 404 to display colors for windows. These requests are sent to Xserver 406 and are processed by install color map function 408 in Xserver 406. An Xserver is a graphics device driver that displays an application, such as application 400 or 402 on a display device. In this example, Xserver 406 processes requests from both local and remote applications. The results of this processing are displayed on a screen by this driver.

The requests are processed to identify the number of entries needed in a color table for each color map. In response to identifying the number of entries needed, install color map function 408 sets the appropriate registers within color table registers 410, which is located within RAMDAC 412 in graphics adapter 404. Based on the location and size set for the color maps in color table registers 410, install color map function 408 then loads the color maps into color table 414 in RAMDAC 412.

In this manner, the mechanism of the present invention allows for multiple color maps of different sizes to be placed into color table 414 through dynamic sizing within color table 414. As a result, color table 414 is in essence multiple color tables in which each of these color tables have sizes that are created to support different sized color maps.

Figure 5:
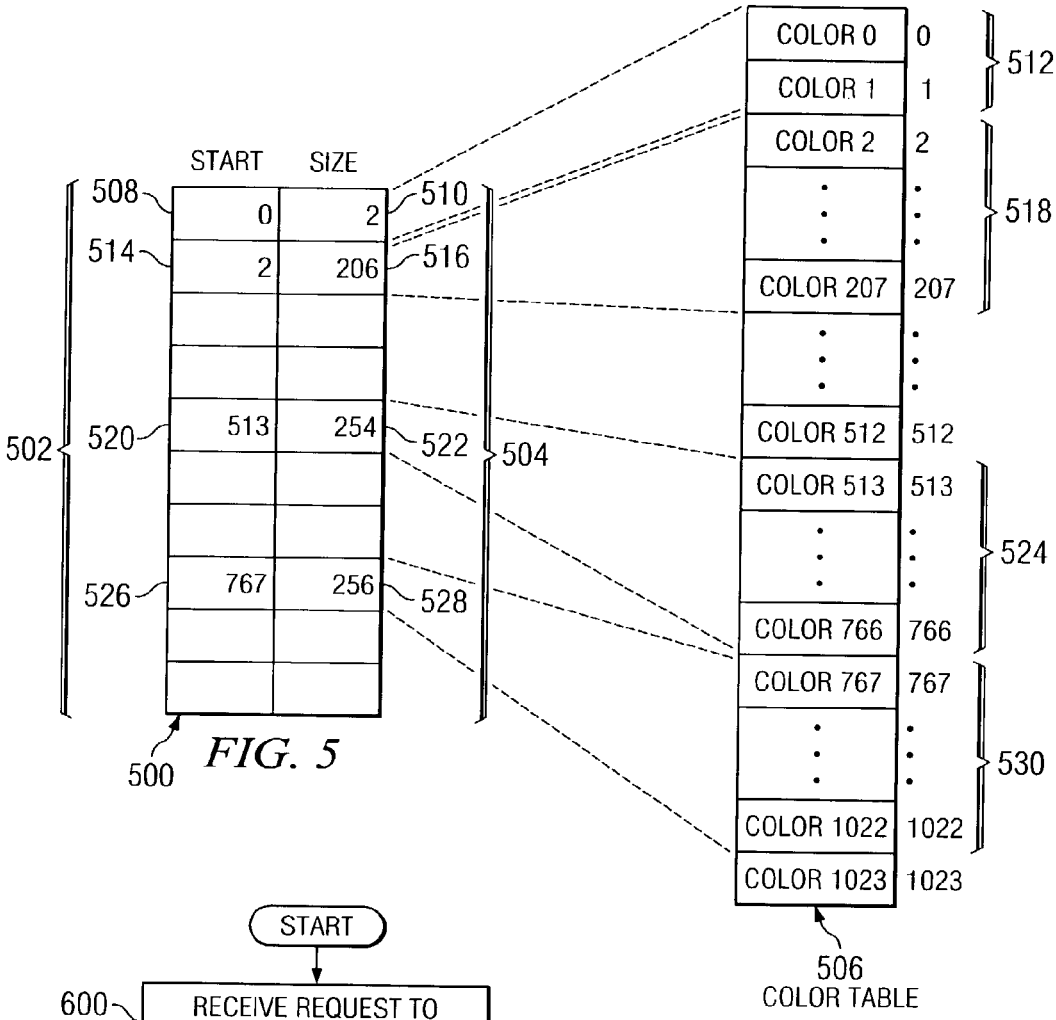
FIG. 5 is a diagram illustrating color table registers for defining location and number of entries for color maps within a color table in accordance with a preferred embodiment of the present invention.

With reference next to FIG. 5, a diagram illustrating color table registers for defining location and number of entries for color maps within a color table is depicted in accordance with a preferred embodiment of the present invention. In this example, registers 500 include start registers 502 and size registers 504. As illustrated, four color maps are illustrated by registers 500 in this example.

Start registers 502 are used to identify the starting points for entries within color table 506. Size registers 504 are used to define the number of color table entries that will be dynamically allocated for a first color map. For example, start register 508 indicates that the starting address for a color map is at address 0, with a size of 2, as shown in register 510. This corresponds to section 512 within color table 506. Another color map is defined by registers 514 and 516. Register 514 indicates that the color map will start at address 2, while register 516 indicates that 206 entries are used for this color map. Section 518 in color table 506 is defined by these registers. Register 520 indicates a starting address of 513, while register 522 indicates that 254 entries are used for this third color map. These two registers define the third color map as being located within section 524 in color table 506. In another example, register 526 indicates that a fourth color map begins at address 767, while register 528 indicates that this color map contains 256 entries. These registers define section 530 in color table 506 for this fourth color map.

Figure 6:
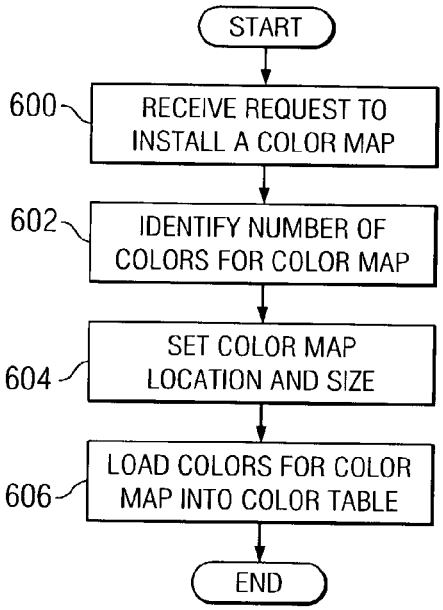
FIG. 6 is a flowchart of a process for dynamically loading color maps into a dynamically sized color table in accordance with a preferred embodiment of the present invention.

Turning now to FIG. 6, a flowchart of a process for dynamically loading color maps into a dynamically sized color table is depicted in accordance with a preferred embodiment of the present invention. The process illustrated in FIG. 6 may be in a graphics process such as Xserver 406 in FIG. 4.

The process begins by receiving a request to install a color map (step 600). This request is typically received from an application or window manager and usually includes a number of entries required for the color map. The application or window manager passes in a color map identifier to the process. With this identifier, internal color map structures may be accessed to see how many colors the color map has, the actual colors, and if the colors are already loaded into the color table. Based on the requests received, a number of colors for the color maps is identified (step 602). A color map location and size is set based upon the number of colors identified (step 604). These examples, the number of colors equals the number of entries needed in the color table. The location and size is set by setting registers within the graphics adapter. These are registers that are specifically designed for setting a location and size for a color map within a color table. Thereafter, the colors for the color map are loaded into the color table (step 606) with the process terminating thereafter.

Thus, The present invention provides a method, apparatus, and computer instructions for managing color tables in a graphics adapter. The mechanism of the present invention allows for dynamic sizing within a color table to allow for multiple color maps to be placed within the color table. Each color map is allocated only with as much space as needed for a particular color map, rather than a set allocation. For example, if a color map only includes two colors, only two entries are allocated, while a color map having 256 colors is allocated 256 entries. This mechanism does not require any changes or modifications to applications requesting color maps. Instead, a set of registers are included within the graphics adapter in which these registers are used to set locations and sizes of color maps within a color table. With this mechanism, improved efficiency in color table usage is provided, reducing the need to implement large numbers of expensive color tables. Further, this mechanism provides improved usability over current color tables, reducing the occurrence of technicolor.

It is important to note that while the present invention has been described in the context of a fully functioning data processing system, those of ordinary skill in the art will appreciate that the processes of the present invention are capable of being distributed in the form of a computer readable medium of instructions and a variety of forms and that the present invention applies equally regardless of the particular type of signal bearing media actually used to carry out the distribution. Examples of computer readable media include recordable-type media, such as a floppy disk, a hard disk drive, a RAM, CD-ROMs, DVD-ROMs, and transmission-type media, such as digital and analog communications links, wired or wireless communications links using transmission forms, such as, for example, radio frequency and light wave transmissions. The computer readable media may take the form of coded formats that are decoded for actual use in a particular data processing system.

The description of the present invention has been presented for purposes of illustration and description, and is not intended to be exhaustive or limited to the invention in the form disclosed. Many modifications and variations will be apparent to those of ordinary skill in the art. The embodiment was chosen and described in order to best explain the principles of the invention, the practical application, and to enable others of ordinary skill in the art to understand the invention for various embodiments with various modifications as are suited to the particular use contemplated.

What is claimed is:

1. A method in a data processing system for storing colors in a color table used in displaying graphics, the method comprising a computer executing:

receiving a request for a color map, wherein the request includes a number of entries for the color map;

setting a color map location and size in the color table based on the number of entries in the request;

loading colors for the color map into the color table at the color map location, wherein dynamic sizing of color tables occurs;

receiving a second request for a second color map, wherein the second request includes a second number of entries for the second color map;

setting a second color map location and second size in the color table based on the second number of entries in the second request; and loading colors for the second color map into the color table at the second color map location, wherein the color map and the second color map are both loaded in the color table.

2. The method of claim 1, wherein the color map has 2 entries.

3. The method of claim 1, wherein the location and the size for the color map are set in color table registers in a graphics adapter.

4. The method of claim 1, wherein the color table is located in the graphics adapter.

5. A display apparatus comprising:

a random access memory digital to analog converter unit;

a plurality of color table registers located within the random access memory digital to analog converter unit; and a color table that stores a plurality of color maps connected to the set of color table registers, wherein the color table registers include a set of location registers that each specify a location of a respective color map within the color table and a set of size registers that each specify a size of a respective color map within the color table, wherein each of the plurality of color maps has a corresponding location register in the set of location registers and size register in the set of size registers.

6. A data processing system for storing colors in a color table used in displaying graphics, the method comprising:

receiving means for receiving a request for a color map, wherein the request includes a number of entries for the color map;

setting means for setting a color map location and size in the color table based on the number of entries in the request;

loading means for loading colors for the color map into the color table at the color map location, wherein dynamic sizing of color tables occurs;

second receiving means for receiving a second request for a second color map, wherein the second request includes a second number of entries for the second color map;

second setting means for setting a second color map location and second size in the color table based on the second number of entries in the second request; and second loading means for loading colors for the second color map into the color table at the second color map location, wherein the color map and the second color map are both loaded in color table.

7. The data processing system of claim 6, wherein the color map has 2 entries.

8. The data processing system of claim 6, wherein the location and the size for the color map are set in cola table registers in a graphics adapter.

9. The data processing system of claim 6, wherein the color table is located in the graphics adapter.

10. A non-transitory computer readable medium having instructions encoded thereon for storing colors in a color table used in displaying graphics, said instructions implementing a method comprising:

receiving a request for a color map, wherein the request includes a number of entries for the color map;

setting a color map location and size in the color table based on the number of entries in the request; and loading colors for the color map into the color table at the color map location, wherein dynamic sizing of color tables occurs;

receiving a second request for a second color map, wherein the second request includes a second number of entries for the second color map;

setting a second color map location and second size in the color table based on the second number of entries in the second request; and loading colors for the second color map into the color table at the second color map location, wherein the color map and the second color map are both loaded in the color table.

11. The non-transitory computer readable medium of claim 10, wherein the color map has 2 entries.

12. The non-transitory computer readable medium of claim 10, wherein the location and the size for the color map are set in color table registers in a graphics adapter.

13. The non-transitory computer readable medium of claim 10, wherein the color table is located in a graphics adapter.

* * * * *